US005332164A

United States Patent [19]

Page

[11] Patent Number: 5,332,164

[45] Date of Patent: Jul. 26, 1994

[54] MATERIALS GRINDER

[75] Inventor: James H. Page, Bottineau, N. Dak.

[73] Assignee: Rexworks, Inc., Milwaukee, Wis.

[21] Appl. No.: 636,505

[22] Filed: Dec. 31, 1990

[51] Int. Cl.[5] ..... B02C 18/14; B02C 18/28

[52] U.S. Cl. ..... 241/239; 241/242; 241/285.3; 241/289; 241/294

[58] Field of Search ..... 241/32, 241, 242, 285 B, 241/289, 294, 239

[56] References Cited

U.S. PATENT DOCUMENTS

| | | | |
|---|---|---|---|
| 1,735,824 | 11/1929 | Huffman | 241/32 |
| 3,098,614 | 7/1963 | Meyer | 241/294 |
| 4,903,903 | 2/1990 | Benen | 241/101.7 |
| 4,905,919 | 3/1990 | Okazaki | 241/160 |

FOREIGN PATENT DOCUMENTS

| | | | |
|---|---|---|---|
| 0182749 | 5/1986 | European Pat. Off. | 241/285 B |
| 3543902 | 5/1987 | Fed. Rep. of Germany | 241/154 |
| 3644169 | 7/1988 | Fed. Rep. of Germany | 241/294 |
| 1238787 | 6/1986 | U.S.S.R. | 241/289 |

*Primary Examiner*—Mark Rosenbaum
*Assistant Examiner*—John M. Husar
*Attorney, Agent, or Firm*—Reinhart, Boerner, Van Deuren, Norris & Rieselbach

[57] ABSTRACT

A materials grinder for comminuting large "chunks" of aggregated material having a conveyor for transporting quantities of materials, including large "chunks" thereof, and a grinder having a large chamber for receiving and grinding the material into smaller and generally uniform sized particulates wherein the grinder is comprised of upper and lower grinding drums to said lower grinding drum, the guide means including breaker bars for controlling the flow of materials adjacent said grinding means and for determining the size of the particulate ground at each grinding drum.

7 Claims, 6 Drawing Sheets

MATERIALS GRINDER

CROSS-REFERENCE TO RELATED APPLICATION

The subject matter of the present invention is related to the subject matter of co-pending U.S. patent application entitled "ASPHALT GRINDER", Ser. No. 636,510, now abandoned, filed Dec. 31, 1990 by Robert J. Page.

BACKGROUND OF THE INVENTION

1. Field of the invention

This invention relates generally to materials grinding apparatus and is more particularly directed to an apparatus for recycling aggregate structures such as asphaltic roadway, curbs, or other structures comprised of an asphaltic aggregate although the invention is not limited to the reduction of chunks of asphaltic aggregate materials and structures as my invention may be operable with materials to be comminuted that are of diverse structural and material characteristics.

2. Description of the Prior Art

The aforementioned co-pending U.S. patent application Ser. No. 636,510, now abandoned describes and claims an "ASPHALT GRINDER" and includes a listing of prior art also known to me.

The prior art does include examples of apparatus designed to comminute aggregate material into a particulate form for recycling or reuse. The prior art may accomplish the desired results, however, I have not sought to test the prior art except to note that it is not believed suitable for the requirements of the present state-of-the-art of, for example, roadway construction and reconstruction.

SUMMARY OF THE INVENTION

The present invention provides an improved aggregate grinding apparatus for reducing chunks of, for example, asphaltic aggregate structures to substantially uniform particulate material of a predetermined size.

My invention contemplates the use of a plurality of horizontally disposed, vertically spaced grinding drums which are operable in an enclosure which provides for successive serial processing of asphaltic aggregate chunks of materials, resulting from the disassembly of structures incorporating such materials, into successively smaller and smaller chunks and particles through the co-action of rotatable grinding drums with adjacently disposed breaker bars that are positioned to permit co-action between grinding teeth suitably mounted upon the grinding drums, the material to be comminuted and the breaker bars to result in the reduction of the chunks of material to a substantially uniform particulate state.

The grinding drums of my apparatus are provided with segmental tooth mounting elements which are easily and quickly removable and replaceable and the teeth which carry grinding bits of suitable hard material, such as carbide, are configured to resist failure and to distribute the wear occasioned by the grinding process in a uniform manner so that the carbide bits will wear evenly and therefore have a longer effective useful life.

My invention also provides for a safety release which may permit the passage of unduly hard materials in the stream of operation of my apparatus which is automatic in operation in that the hard materials are permitted to pass and to bypass the grinding operation and thereby reduce damage and then to return to the normal operative position automatically. The same apparatus provides for suitable adjustment of the grinding operation to determine the size of the ground particulate furnished and to accommodate differing sizes of materials to be processed.

Other objects and advantages of my invention will be evident from the following detailed description when read in conjunction with the accompanying drawings which illustrate preferred embodiments of my invention.

DESCRIPTION OF THE ILLUSTRATED EMBODIMENT

Figure 1:
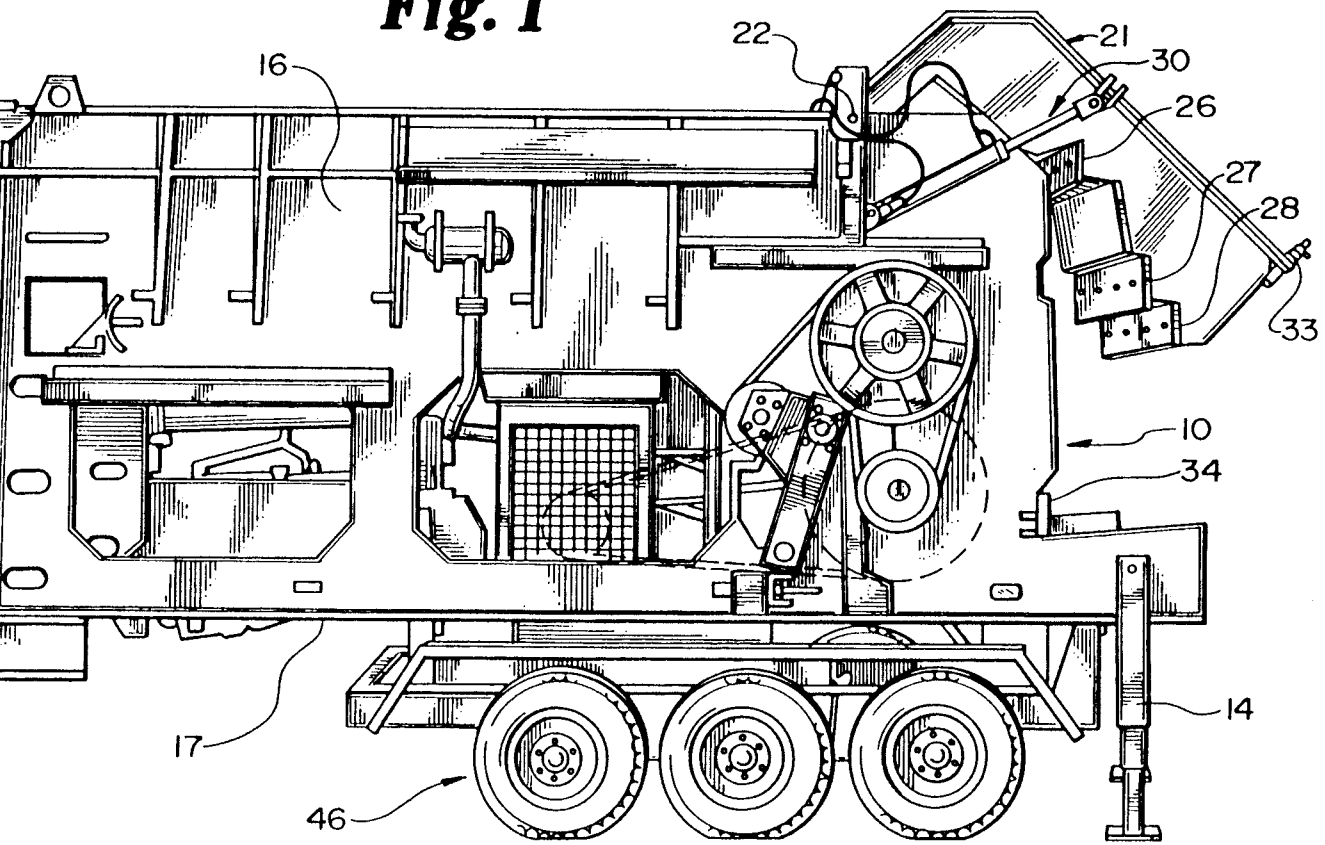
FIG. 1 is a left side perspective view of my invention.
Figure 2:
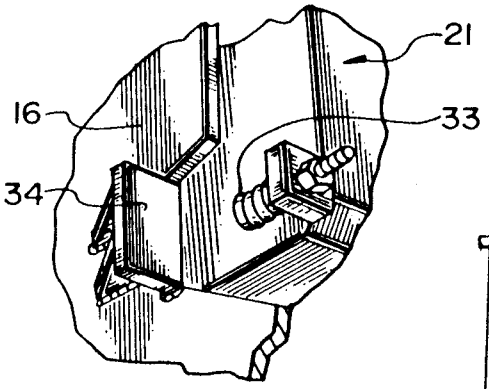
FIG. 2 is a fragmentary perspective detail of a portion thereof.

Referring now to the drawings, my materials grinder is shown comprised of a frame 10 which is generally open-ended at the top to receive materials to be ground into smaller size and is open at the lower rear end to discharge the ground material.

Frame 10 is shown having a forwardly extending transport tongue 11 with a hitch 12 at the forward end for attachment to a suitable transport vehicle and a pair of front support legs 13 depending downwardly therefrom. A similar pair of support legs 14 are shown extending downwardly from the rear end of frame 10. A wheel assembly 46 may be removably disposed underneath frame 10 for transporting the apparatus from one location to another.

Frame 10 is comprised of right and left side walls 15 and 16, a bottom 17, a front 18, a horizontal partition 19 extending between right and left side walls 15 and 16, a vertical partition 20 extending downwardly from the rear end of horizontal partition 19 and a rear door 21 that is disposed for rotation about a pivot 22 at the upper rear end of frame 10. Rear door 21 includes an outer cover 24 and an inner cover 25 across which extend first, second and third breaker bars 26, 27 and 28, respectively. Rear door 21 may be pivoted about axis 22 through the action of right and left rams 29 and 30 that are connected between right and left side walls 15 and 16 of frame 10 and the side portions of door 21. Door 21 may be operable between an open position and a closed position determined by right bumper and pad 31 and 32 and left bumper and pad 33 and 34. A guide-shield 35 is shown disposed intermediate right and left side walls 15 and 16 for purposes to be explained below. A discharge conveyor 36 including a belt 37 and rollers 38 is disposed underneath the rear portion of frame 10 for conveying the ground particulate that is discharged by my materials grinder.

An infeed conveyor 40 comprised of a belt 41, including flights 42 and rollers 44 is shown disposed over a floor 43 extending intermediate right and left side walls 15 and 16.

A first grinding drum 50 having a plurality of grinding teeth 51 disposed on removable segments 52 that are mounted on a shaft 53 and a second grinding drum 56 including a plurality of teeth 57 that are disposed on removable segments 58 on a shaft 59 are shown extending intermediate right and left side walls 15 and 16 and are operable in the directions indicated by the arrows when suitably driven.

Figure 8:
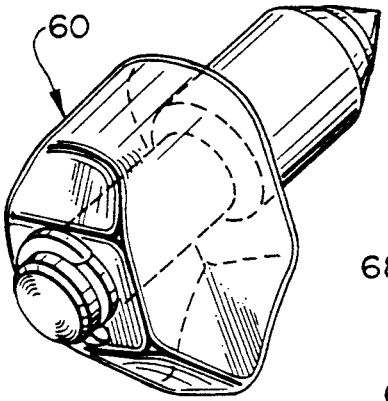
FIG. 8 is a detailed perspective view of a typical grinding element.
Figure 9:
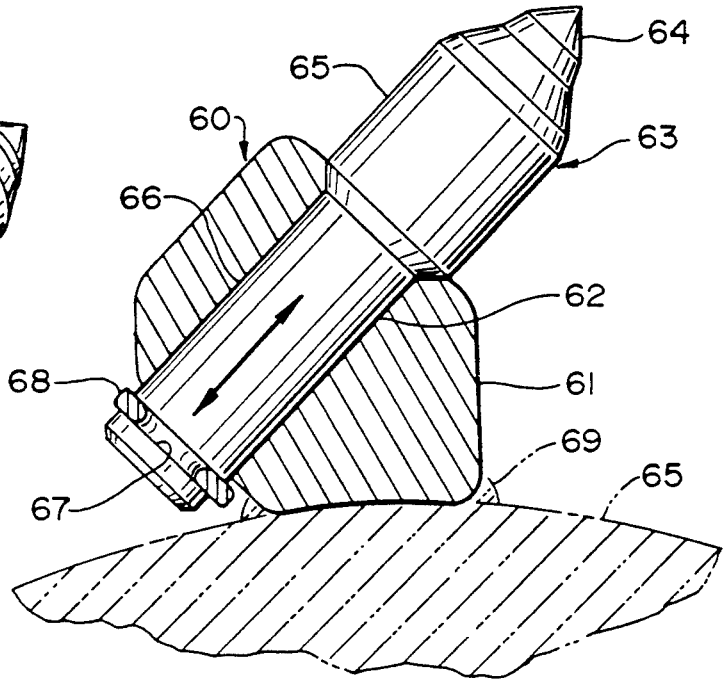
FIG. 9 is a sectional view taken along section line 9—9 of FIG. 8.
Figure 10:
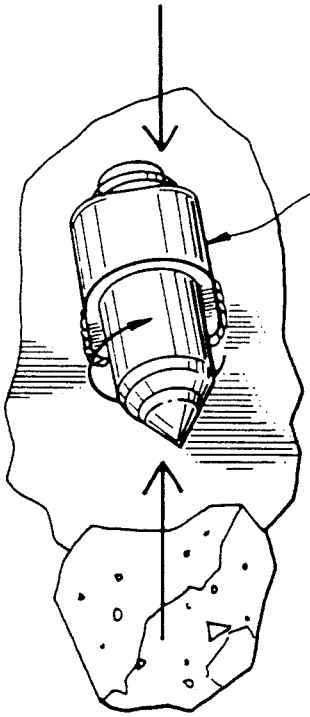
FIG. 10 is a fragmentary pictorial diagram illustrating the dynamic functions of the subject matters of FIGS. 8 and 9.

Referring specifically to FIGS. 8, 9 and 10 of the drawings, a grinding tooth 60 (identified by reference characters 51 and 57 on the remainder of the drawings) is shown having a base 61 with a bit receiving hole 62 and a grinding bit 63 disposed in hole 62. Grinding bit 63 includes a conical tip 64, comprised of a suitable hard material such as carbide steel, is shown disposed on the end of a barrel 65 having a shank 66 that is of reduced diameter and longer than hole 62 in tooth 60. A suitable groove 67 for receiving a snap ring retainer is provided on the end of shank 66 for assembly in the manner shown in the drawings. The base 61 of tooth 60 may be attached to a drum segment 75 through the use of suitable welding techniques which result in the weldments 69.

Figure 11:
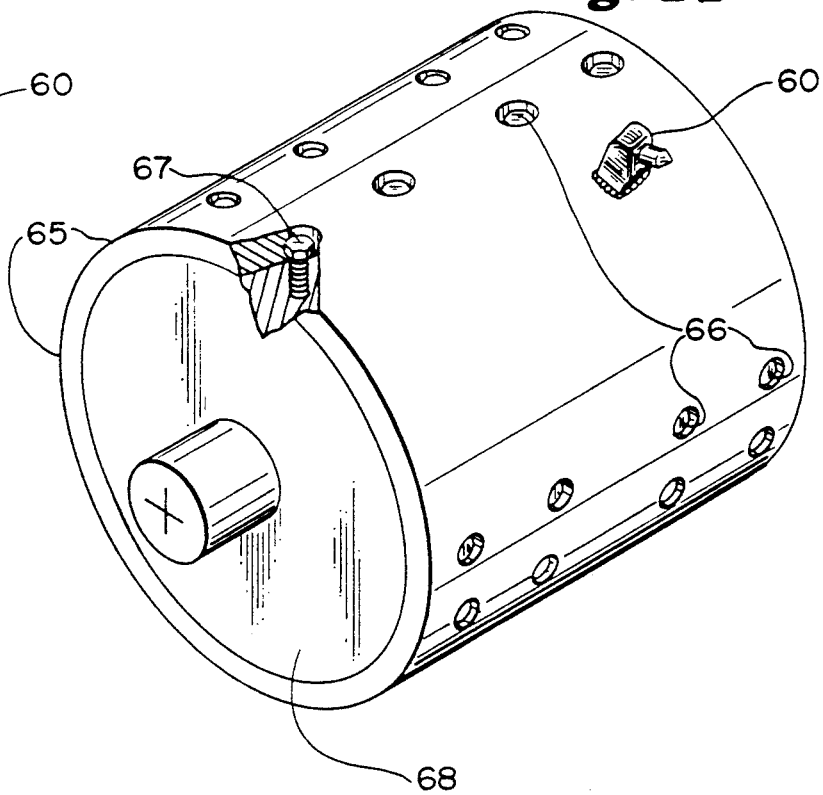
FIG. 11 is a perspective sketch of some of the detail of a grinding drum used in my apparatus.

As shown in FIG. 11 of the drawings, each grinding drum is provided with a plurality of drum segments 75 (shown as elements 52 and 58 in the remainder of the drawings), each having a plurality of holes 76 for receiving bolts 77 that are attached to the shaft 78 of a grinding drum (identified by reference characters 53 and 59 on the remainder of the drawings).

Teeth 60 are shown disposed on the outer periphery of the drum segments in an irregular pattern as this results in a more efficient and complete reduction of the aggregate material into the desired particulate state.

Figure 3:
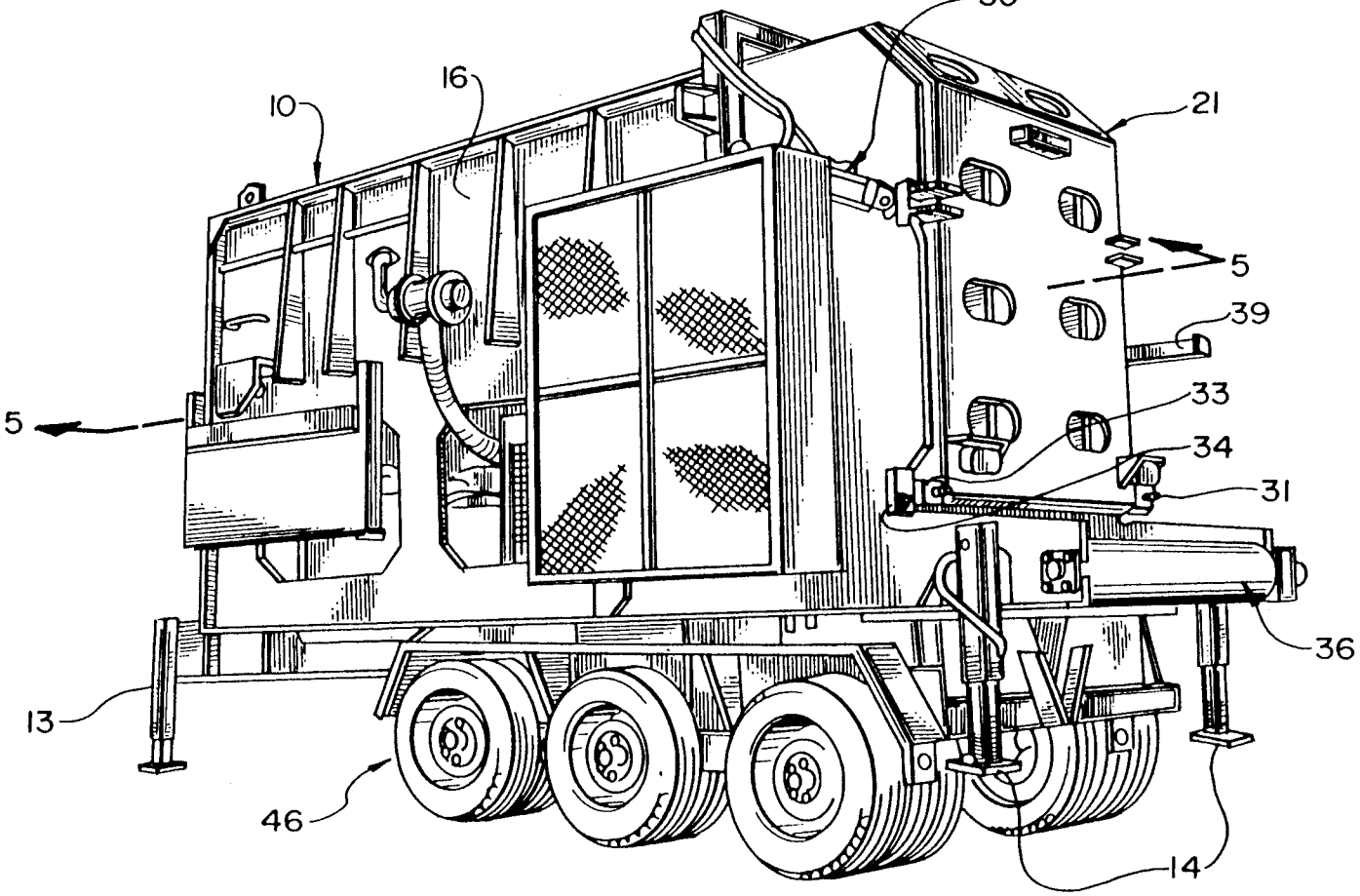
FIG. 3 is a left rear perspective view.
Figure 4:
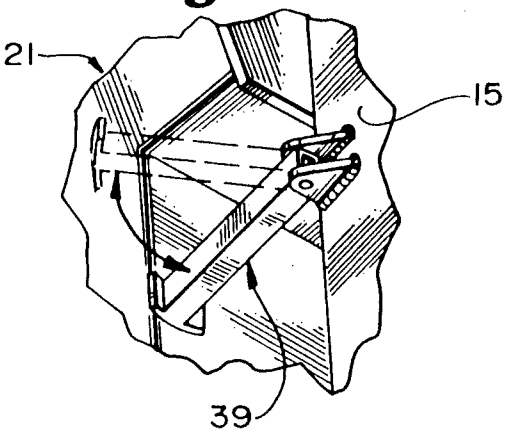
FIG. 4 is a fragmentary perspective view of a portion of FIG. 4.

A rear door support for maintaining rear door 21 in an open or raised state is hingedly attached to the intermediate rear side of right side wall 15, as is in FIGS. 3 and 4.

Right and left rams are preferably driven by a hydraulic system which will provide an open and closing position for rear door 21 as well as including an accumulator, or the like, to permit the opening of rear door 21 in the event a large, hard chunk of material finds its way into the body of frame 10 at which point, rather than allowing the machine to self-destruct, the door is permitted to open and the chunk to pass to the rear of frame 10 in an unground state.

The relative position of right and left bumpers on rear door 21 may be seen to control the closed position of rear door 21 so that breaker bars 26, 27 and 28 may be moved closer to or farther away from the peripheries of grinding drums 50 and 56 to thereby control the size of the particulate product that is discharged onto the top of discharge conveyor 36 for removal from the body of frame 10.

Right and left rams 29 and 30 might be similarly comprised of mechanical spring-loaded structures which will permit the operation described above.

Also shown on the drawings, but not specifically identified are suitable driving arrangements for rotating first and second drums 50 and 56 as well as discharge conveyor 36. There is no driving means shown for infeed conveyor 40 although this may be readily supplied by one skilled in the art when seeking to employ the principles of my invention.

Operation of the Illustrated Embodiment

Figure 5:
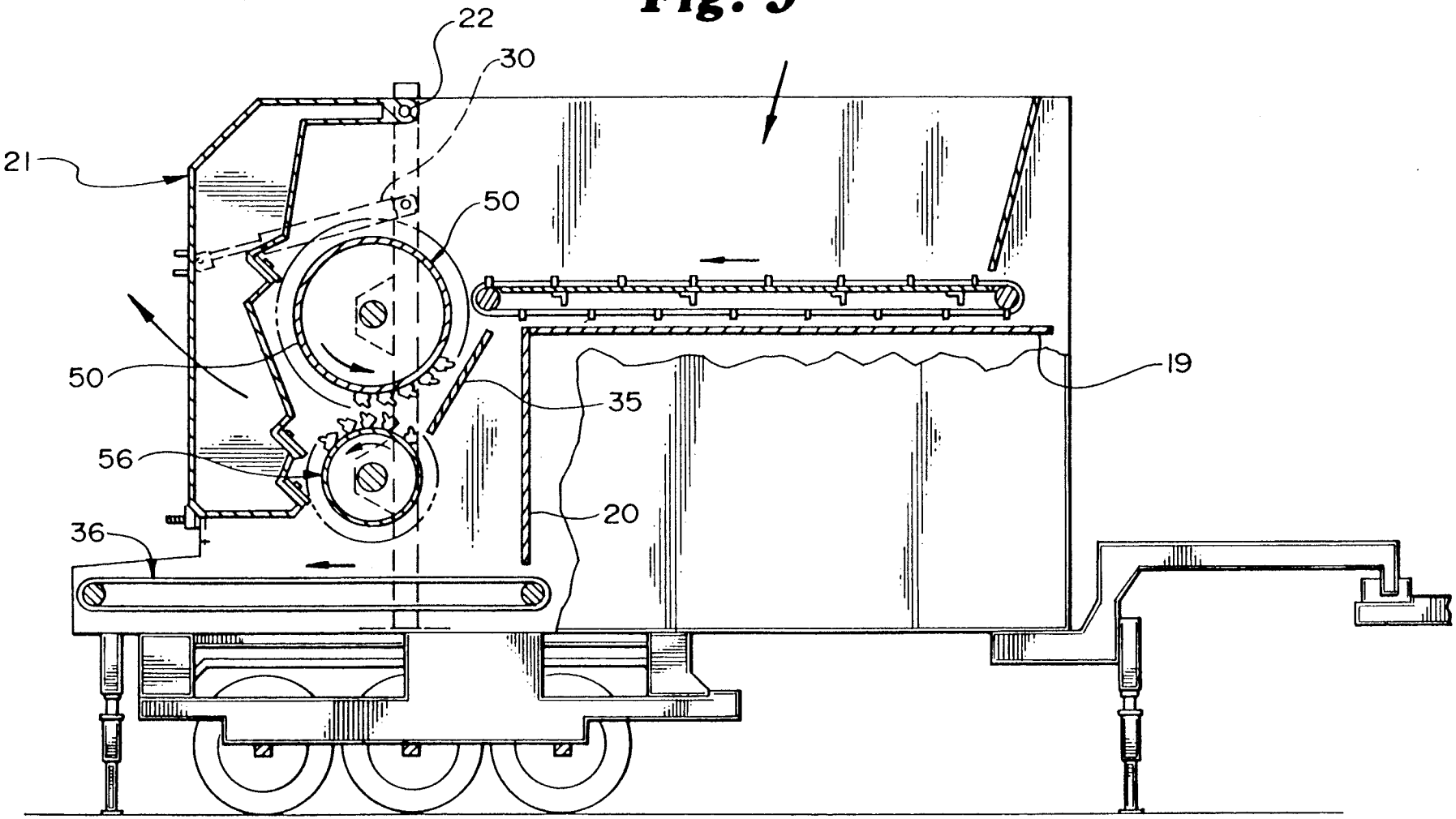
FIG. 5 is a sectional elevational view taken along section line 5—5 on FIG. 3.
Figure 6:
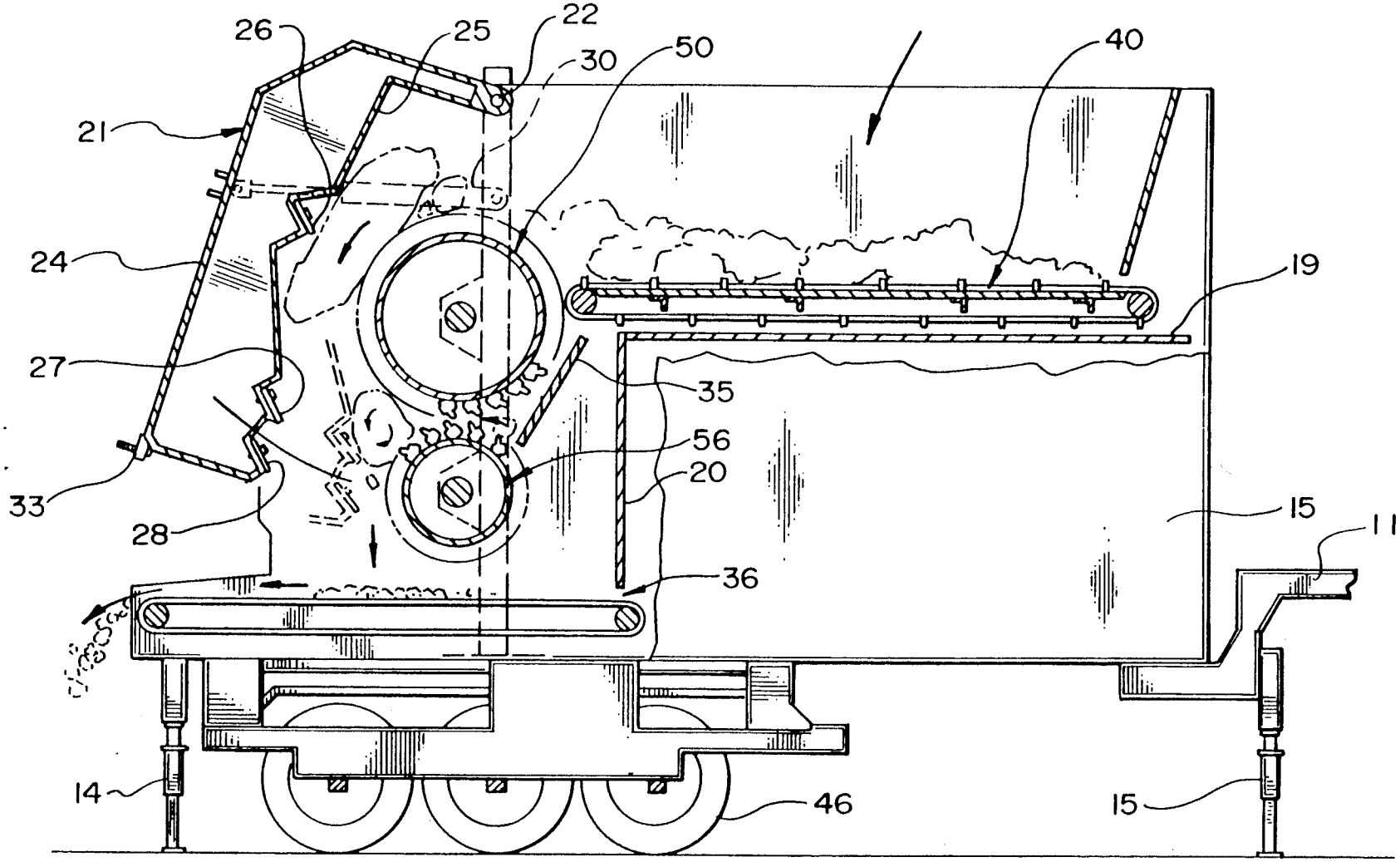
FIG. 6 is a view similar to that of FIG. 5 showing some of the moveable parts of the apparatus in an alternate dynamic position and illustrating workpiece material in phantom dashed line.
Figure 7:
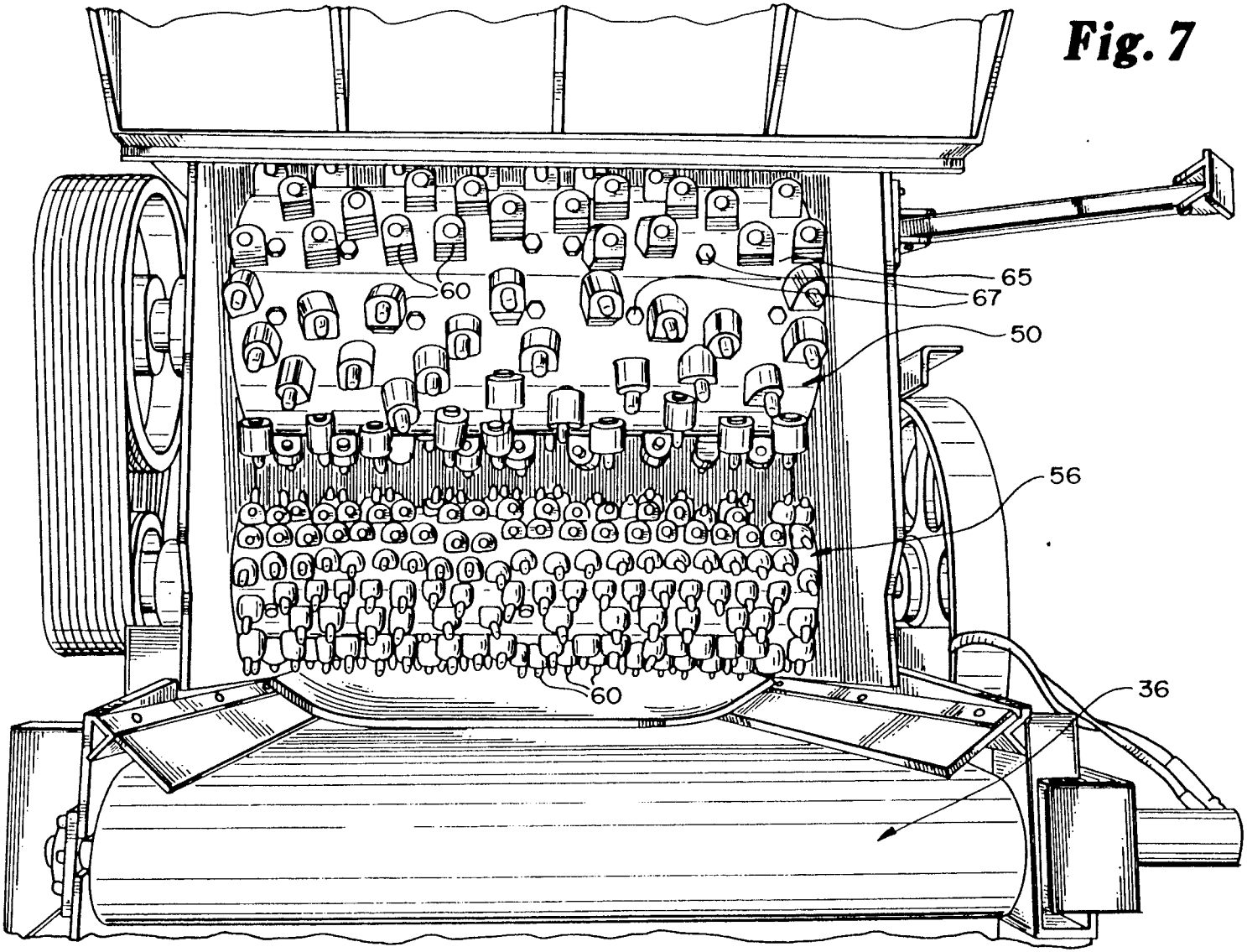
FIG. 7 is a fragmentary rear perspective view with the rear door shown in an open position to reveal the interior.

FIGS. 5 and 6 are illustrative of the operation of my invention and, as may be seen, frame 10 is open at its forward upper end to receive a quantity of aggregate material, in chunks of various sizes, on the top of infeed conveyor 40. Grinding drums 50 and 56 are caused to rotate in the directions shown, namely, counter-clockwise, and rear door 21 is caused to be closed, as in the position of FIG. 5. Infeed conveyor 40 may then be operable to convey chunks of material into the right top upper side of drum 50 whereat the abrasion process is initiated and the material is then caused to move upwardly and onto the drum 50, down into the space between drum 50 and breaker bar 26 to effect a further abrasion and reduction in the size of the chunks and downwardly into contact with the cutting teeth on drum 56 and breaker bars 27 and 28 and then onto the surface of discharge conveyor 36 for transfer to the rear of frame 10.

Materials of the size that may pass between the left end of infeed conveyor 40 and the teeth on rotating grinding drum 50 are guided by shield 35 down onto the right upper side of rotating drum 36 so that the materials may be abraded intermediate the teeth on drum 50 and the teeth on drum 56 and then further processed between the teeth on drum 56 and breaker bars 27 and 28.

Drums 50 and 56 are typically caused to rotate with the tip speed on each of the drums at approximately the same speed although individuals skilled in the art may determine that other relative velocities may be appropriate depending upon the nature of the materials that are to be ground.

As stated above, normal operation of my apparatus is as illustrated in FIG. 5 and rear door 21 is in a position determined by the biasing force exerted by right and left rams 29 and 30 to a position determined by the disposition of right and left bumpers 31 and 33 with respect to their pads 32 and 34.

When a large chunk of material that is not readily abraded or ground by the surface of drum 50 or a like or similar chunk with respect to the surface of drum 56, rear door 21 may be seen to move in a clockwise direction against the biasing force supplied by rams 29 and 30 so that rear door 21 may lift up and the large chunks of "ungrindable material" may fall to the bottom of frame 10 and be conveyed to the rear of the apparatus.

An angle of 40 to 60 degrees, with respect to the horizontal, is determined to be a suitable disposition for breaker bars 26, 27, and 28. While these elements are not shown to be adjustable in the drawings, it is anticipated that the inner liner 25 of rear door 21 could be similarly configured to provide a range of angular disposition with respect to a horizontal plane and thence with respect to the outer surfaces of rotating grinding drums 50 and 56.

It may be noted that the aggregate to be ground or reduced to a particulate state proceeds serially from on top of infeed conveyor 40, into over and around rotating drum 50, down into the left side of rotating drum 56 and thence downwardly onto the top of discharge conveyor 36. It is anticipated that certain materials may require more than two stages of grinding, and therefore, those skilled in the art with which my invention is concerned may now perceive that the serial sequence of grinding operations proceeds downwardly through a vertical path and one might reasonably provide a greater number of stages in vertical spaced relationship together with breaker bars and the like to effect the necessary grinding reduction of the particulate size.

Referring to the detailed drawings of the grinding teeth 60 in FIGS. 8–10, it may be seen that a grinding bit 63 is rotatably and reciprocally disposed in a base 61 so that during normal operation, grinding bit 63 may rotate so as to provide even wear on conical tip 64 and to accommodate the reciprocal movement so as to compensate for varying thrusts imposed on the tooth assembly. Individual grinding bits 63 may be replaced as needed or the complete segments 75 may be replaced entirely or as needed on the surface of drum shafts 68 for drums 50, 56, or any others involved in a given apparatus.

I claim:

1. A materials grinder comprising in combination:

a vertically disposed, upwardly opening chamber provided with an access door and having the materials guiding breaker bar means mounted on said door;

a plurality of materials grinding cutting drums disposed in vertically spaced relationship for rotation within said chamber;

means for conveying materials to be ground into the top of said chamber; and said materials guiding breaker bar means disposed in said chamber, adjacent to said material grinding drums, whereby materials to be ground are successively supplied to each of said material grinding drums.

2. The apparatus of claim 1 in which the access door is biased into a closed position.

3. The apparatus of claim 2 in which the materials grinding drums are provided with a plurality of teeth.

4. The apparatus of claim 3 in which the teeth are mounted on removable segments.

5. The apparatus of claim 4 in which the teeth include rotatable grinding bits.

6. The apparatus of claim 5 in which the grinding bits are reciprocally mounted on the drums.

7. The apparatus of claim 6 in which the drums are rotatably driven to provide a substantially equal tooth velocity.

* * * * *